United States Patent [19]

Braytenbah et al.

[11] 4,007,596

[45] Feb. 15, 1977

[54] DUAL TURBINE POWER PLANT AND METHOD OF OPERATING SUCH PLANT, ESPECIALLY ONE HAVING AN HTGR STEAM SUPPLY

[75] Inventors: Andrew S. Braytenbah, Pennsauken, N.J.; Karl O. Jaegtnes, Chester, Pa.

[73] Assignee: Westinghouse Electric Corporation, Pittsburgh, Pa.

[22] Filed: Apr. 24, 1975

[21] Appl. No.: 571,145

[52] U.S. Cl. ..... 60/652; 60/644; 60/653; 60/658; 60/679; 60/663; 60/706; 60/662

[51] Int. Cl.[2] ..... F01K 13/02

[58] Field of Search ..... 60/644, 646, 658, 679, 60/706, 707, 711, 652, 653

[56] References Cited

UNITED STATES PATENTS

| | | | |
|---|---|---|---|
| 3,030,779 | 4/1962 | Hryniszak et al. | 60/644 X |
| 3,108,938 | 10/1963 | Nettel et al. | 60/644 X |

*Primary Examiner*—Allen M. Ostrager
*Attorney, Agent, or Firm*—H. W. Patterson

[57] ABSTRACT

A power plant including dual steam turbine-generators connected to pass superheat and reheat steam from a steam generator which derives heat from the coolant gas of a high temperature gas-cooled nuclear reactor. Associated with each turbine is a bypass line to conduct superheat steam in parallel with a high pressure turbine portion, and a bypass line to conduct superheat steam in parallel with a lower pressure turbine portion. Auxiliary steam turbines pass a portion of the steam flow to the reheater of the steam generator and drive gas blowers which circulate the coolant gas through the reactor and the steam source. Apparatus and method are disclosed for loading or unloading a turbine-generator while the other produces a steady power output. During such loading or unloading, the steam flows through the turbine portions are coordinated with the steam flows through the bypass lines for protection of the steam generator, and the pressure of reheated steam is regulated for improved performance of the gas blowers.

33 Claims, 5 Drawing Figures

DUAL TURBINE POWER PLANT AND METHOD OF OPERATING SUCH PLANT, ESPECIALLY ONE HAVING AN HTGR STEAM SUPPLY

CROSS REFERENCES TO RELATED APPLICATIONS

Reference is made to the following previously filed and copending applications assigned to the present assignee:

"HTGR Power Plant Hot Reheat Steam Pressure Control System", Ser. No. 463,027, filed on Apr. 22, 1974 by Andrew S. Braytenbah and Karl O. Jaegtnes;

"HTGR Power Plant Turbine-Generator Load Control System", Ser. No. 464,027, filed on Apr. 25, 1974 by Andrew S. Braytenbah and Karl O. Jaegtnes;

"Load Control System Especially Adapted for HTGR Power Plant Turbine", Ser. No. 497,608, filed on Aug. 15, 1974 by Ola J. Aanstad; and "Acceleration Control Arrangement for Turbine System, Especially for HTGR Power Plant", Ser. No. 519,703, filed on Oct. 31, 1974 by Ola J. Aanstad.

BACKGROUND OF THE INVENTION

In a dual turbine power plant approximately one-half the generated steam is used by each turbine to rotate an associated generator for purposes of producing electric power. In a single turbine power generating unit, a malfunction of a turbine or its associated valves, piping or condenser, may render the entire unit unusable until necessary repairs are made. In comparison with a single turbine power plant, a dual turbine plant advantageously offers an increased probability that at least one-half the plant's total power output can be generated, since a malfunction as above-mentioned may require shutting down one turbine-generator, but not both.

During operation of a dual turbine plant it is at times necessary to add or remove from service one turbine-generator, with the other turbine-generator already operating. Generally, such addition or removal desirably is performed while maintaining the on-line status of the turbine-generator that is already operating and with a reduced degree of change, if any, of its power output level. In the event that the steam generator contains superheater and reheater sections to generate superheat and reheat steam for use by the turbines, it is necessary that desired minimum steam flows be maintained through the steam generator sections during addition or removal of a turbine-generator from service, for protection of such sections. When auxiliary steam turbines are connected in the turbine steam paths to drive blowers which circulate coolant gas through a nuclear reactor and the steam generator, then regulation of the pressure of steam at the outlet of the reheater section during such addition or removal, desirably improves control of the speed of the gas blowers, and thus control of the flow rate of coolant gas through the reactor.

A proposed arrangement for loading a turbine-generator in a power plant which includes a gas-cooled nuclear reactor steam supply system relates to single turbine plants. It includes a controller for regulating the pressure of steam at the outlet of the reheater section, but an integral mode used in the controller may limit the performance of such regulation if two of the controllers were to operate simultaneously in a dual turbine plant.

There appears to be a need for apparatus and method of adding or removing from service a turbine-generator while another turbine-generator continues to operate in a dual turbine power plant. Such apparatus and method desirably accomplishes such addition or removal with limited effect, if any, on the power output of the turbine-generator that is already operating. In a dual turbine power plant with a gas-cooled nuclear reactor steam supply system and with auxiliary steam turbines connected in the turbine steam paths for driving coolant gas blowers, such addition or removal is further desirably accomplished while maintaining desired minimum steam flows through the steam generator, and regulating the pressure of reheated steam.

The description of prior art herein is made on good faith and no representation is made that any prior art is considered the best pertaining prior art nor that the interpretation placed on it is unrebuttable.

SUMMARY OF THE INVENTION

In accordance with the present invention, a power plant having a high temperature gas-cooled reactor and a steam generator cooperative with the reactor to produce superheat and reheat steam, includes first and second turbine-generators. Each turbine-generator has a high pressure turbine portion to pass superheat steam at a rate controlled by an associated governor valve means and a lower pressure turbine portion to pass reheat steam at a rate controlled by an associated intercept valve means. A main steam bypass means conducts superheat steam from the steam generator to permit a desired minimum flow of such steam through the steam generator at times when the combined steam flow through the high pressure turbine portions is less than such minimum. A hot reheat bypass means conducts reheat steam to maintain the desired minimum flow of reheat steam through the steam generator when the combined flow through the lower pressure turbine portions is less than such minimum. After its passage through the high pressure turbine portions and the main steam bypass means, steam is collected and passed through a reheater section of the steam generator; before it is reheated, a portion of such collected steam drives an auxiliary steam turbine means which in turn drives a means for circulating a coolant gas through the reactor and the steam generator. The associated governor valve means is positioned to decrease the power output of the first turbine-generator to a reduced level that is suitable for tripping the second turbine-generator. By closing the associated governor valve means, the power output of the second turbine-generator is decreased to a level which matches the reduced level of the output of the first turbine-generator, whereupon both the governor valve and the intercept valve means associated with the second turbine-generator are closed to reduce its power output further to a minimum level at which the second turbine-generator may be tripped. At times when the combined power output of the first and second turbine-generators requires less than a desired flow of reheat steam, the steam flow through the hot reheat bypass means is controlled to maintain the desired flow of reheat steam through the steam generator.

DESCRIPTION OF THE PREFERRED EMBODIMENT

Figure 1:
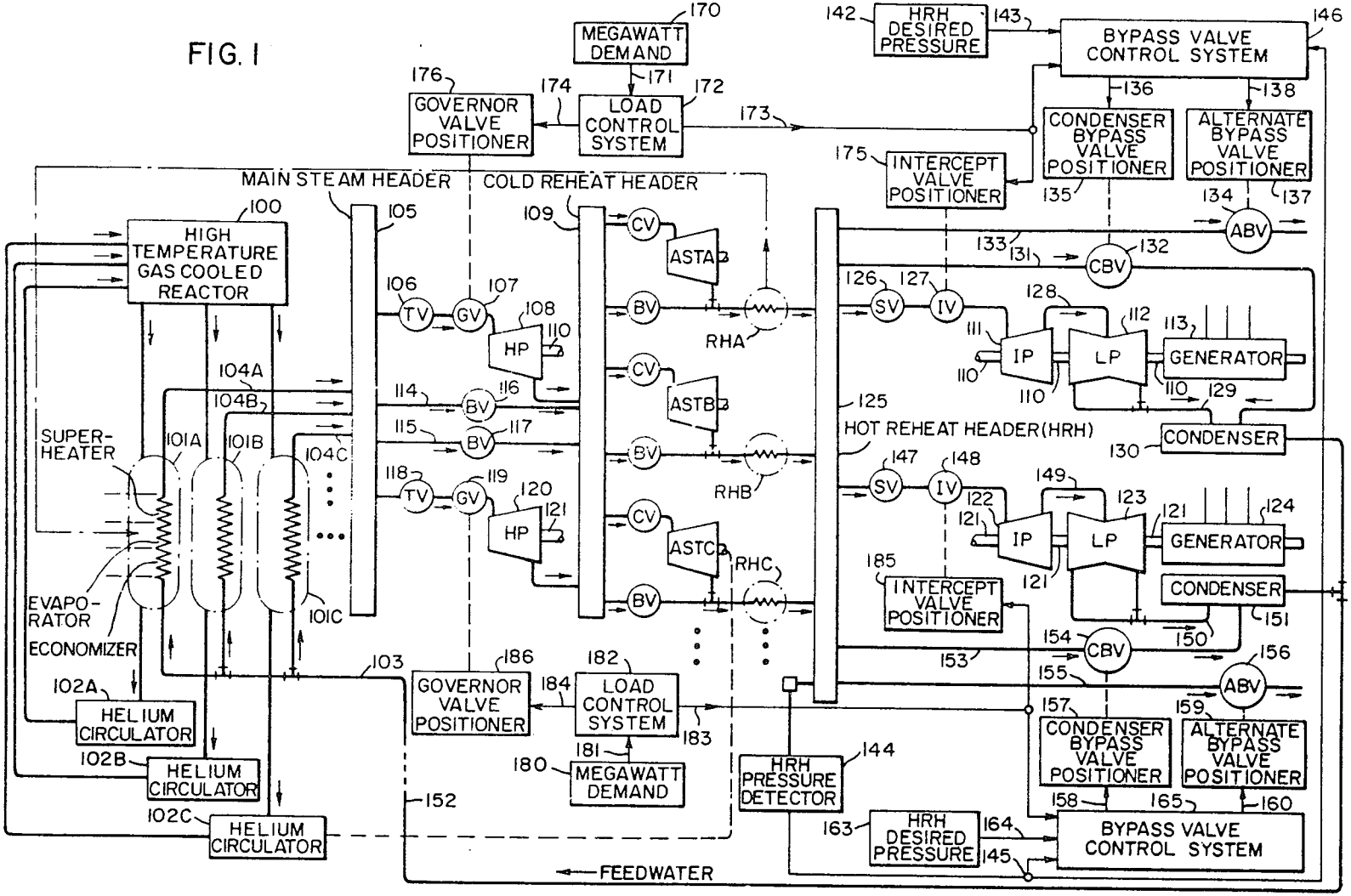
FIG. 1 is a block diagram of a dual turbine HTGR power plant which includes a hot reheat header steam pressure control system according to one embodiment of the invention.

Referring to FIG. 1 each of three helium circulators circulates helium coolant gas through a high temperature gas cooled reactor 100 and an associated steam generator. The steam generators 101A, 101B and 101C are associated with the helium circulators 102A, 102B and 102C respectively. Hot coolant gas is discharged from the reactor 100 and transports reactor-generated heat to each of the three steam generators. A steam generator derives heat from the reactor coolant gas flowing through it, to generate superheated and reheated steam. Feedwater is supplied to each of the steam generators through the line 103, and passes through economizer, evaporator and superheater sections in each steam generator. Superheated steam is discharged from the steam generators through the lines 104A, 104B and 104C, which conduct the superheated steam to a main steam header 105. Each steam generator also incorporates a reheater section, and utilizes reactor-generated heat to reheat a flow of steam through the incorporated reheater section. A dashed line illustrates the incorporation of a reheater section RHA in the steam generator 101A. Reheaters RHB and RHC similarly are incorporated in the steam generators 101B and 101C. Cold reactor coolant gas is discharged from a steam generator and pumped back through the reactor 100 by the associated helium circulator. It is understood that a typical HTGR power plant may employ a number different than three steam generators and associated helium circulators, depending upon the thermal generating capacity of the reactor 100. Additional steam generators would be connected to receive feedwater through the line 103 and to discharge superheated steam to the main stem header 105.

From the main steam header 105 steam may flow through a throttle valve 106 and a governor valve 107 to the inlet of a high pressure turbine 108. Exhaust steam from the high pressure turbine 108 is discharged to a cold reheat header 109. The high pressure turbine 108 turns on a shaft 110 with an intermediate pressure turbine 111, a low pressure turbine 112 and a generator 113, hereafter referred to as the A turbine-generator. Bypass lines 114 and 115 are connected between the main steam header 105 and the cold reheat header 109, and bypass valves 116 and 117 are connected to govern the steam flows through the lines 114 and 115 respectively. Steam also may flow from the main steam header 109 through a throttle valve 118, a governor valve 119, and a high pressure turbine 120, to the cold reheat header 109. The high pressure turbine 120 turns on a shaft 121 with an intermediate pressure turbine 122, a low pressure turbine 123, and a generator 124, hereafter referred to as the B turbine-generator. For most desirable steam generator operation, the steam flow through the superheater sections must be maintained at a level which is at least equal to a desired minimum steam flow. When the combined steam flow through the turbines 108 and 120 is less than the desired minimum, the bypass valves 116 and 117 are positioned to maintain the desired minimum steam flow through the superheater sections. At times when the combined steam flow through the turbines 108 and 120 exceeds the desired minimum, the valves 116 and 117 are closed. A similar desired minimum steam flow must be maintained through the reheater sections. For purposes of this discussion, the desired minimum steam flow is sufficient to generate 25% of maximum power plant output. It is understood that the power output corresponding to the desired minimum steam flow may vary, depending upon the particular design of the steam generators. It is recognized that each of the throttle valves 106 and 118 and each of the governor valves 107 and 119 corresponds to a plurality of such valves in typical practice.

An auxiliary steam turbine ASTA uses steam from the cold reheat header 109 to rotate the helium circulator 102A. Similarly auxiliary steam turbines ASTB and ASTC use steam from the cold reheat header 109 to rotate the helium circulators 102B and 102C respectively. A dashed line connecting the auxiliary steam turbine ASTC and the helium circulator 102C illustrates the rotational coupling of those elements. A control valve associated with each auxiliary steam turbine governs the steam flow through the auxiliary turbine, and thereby governs the rate of flow of reactor coolant gas through the corresponding helium circulator. Exhaust steam from the auxiliary steam turbine ASTA passes to the inlet of the reheater, RHA, and exhaust steam from the auxiliary steam turbines ASTB and ASTC similarly is discharged to the inlets of the respective reheaters RHB and RHC. A bypass line and bypass flow control valve are connected between the cold reheat header 109 and the inlet of each of the reheater sections RHA, RHB and RHC. At times when the total steam flow into the cold reheat header 109 exceeds the total steam flow through the auxiliary steam turbines, the bypass valves associated with the auxiliary steam turbines are positioned such that the bypass lines conduct the excess steam flow directly to the reheater section inlets. A hot reheat header 125 is connected to receive reheated steam from the outlets of the reheater sections. When more than three steam generators are utilized, the reheater section, the helium circulator and the auxiliary steam turbine corresponding to each additional steam generator are connected as above described.

From the hot reheat header 125 steam may flow through a stop valve 126 and an intercept valve 127 to the inlet of the intermediate pressure turbine 111. Exhaust steam from the turbine 111 flows through a line 128 to the inlet of the low pressure turbine 112. A line 129 conducts exhaust steam from the turbine 112 to a condenser 130. A condenser bypass line 131 is connected to conduct steam from the hot reheat header 125 to the condenser 130, and a condenser bypass valve 132 is connected to govern the steam flow through the line 131. An alternate bypass line 133 is connected between the hot reheat header 125 and an alternate steam receiving means, the alternate steam receiving means being atmosphere in FIG. 1. An alternate bypass valve 134 is connected to govern the steam flow through the line 133. The valve 132 is positioned by a valve positioner 135, preferably an electrohydraulic positioner which hydraulically moves the valve 132 to a position related to an electrical signal transmitted to the positioner 135 on a line 136. The valve 134 is positioned by a valve positioner 137, preferably an electrohydraulic positioner which positions the valve 134 at a position related to an electrical input signal transmitted to the positioner 137 on a line 138.

For purposes of this discussion, the stop valve 126 and the throttle valve 106 are assumed to be open, unless otherwise stated. Thus the rate of steam flow through the turbines 111 and 112 is governed by the intercept valve 127, and the rate of steam flow through the turbine 108 is governed by the governor valve 107. A device 170 generates a megawatt demand signal on a line 171 representative of a desired power output of the A turbine-generator. The megawatt demand signal is transmitted to a load control system 172 which generates a signal on a line 173 representative of a desired steam flow through the turbines 111 and 112 (intercept valve flow demand) and a signal on a line 174 representative of a desired position of the governor valve 107. An electrohydraulic valve positioner 175 positions the valve 127 to cause a steam flow through the turbines 111 and 112 that is effectively equal to the desired flow represented by the signal on the line 173. An electrohydraulic valve positioner 176 positions the governor valve 107 at a position represented by the signal on the line 174. As hereinafter described the load control system 172 generates the desired steam flow signal on the line 173 and the desired valve position signal on the line 174 such that the power output of the A turbine-generator conforms to the value represented by the megawatt demand signal on the line 171. The device 170 may be a manually set variable signal generator with an output on the line 171, or the device 170 may be a digital computer programmed to calculate a megawatt demand value that is converted by an associated digital analog converter and transmitted to the line 171. A device 142 generates an output signal on a line 143 which represents a desired value of steam pressure in the hot reheat header 125. The device 142 may be a manually set variable signal generator, with an output on the line 143 or it may be a digital computer programmed to calculate such a desired pressure value, the calculated value being converted by an associated digital to analog converter and transmitted to the line 143. A pressure transducer 144 detects the pressure of steam in the hot reheat header 125, and generates an output signal representative of the detected pressure on a line 145. A bypass valve control system 146 is responsive to the desired pressure signal on the line 143, the detected pressure signal on the line 145, and the desired steam flow signal on the line 173 to generate the valve positioner input signals on the lines 136 and 138 as hereinafter described.

Steam may flow through a stop valve 147 and an intercept valve 148 to the inlet of the intermediate pressure turbine 122. Exhaust steam from the turbine 122 flows through a line 149 to the inlet of the low pressure turbine 123. After flowing through the low pressure turbine 123, steam is conducted by a line 150 to a condenser 151. Condensed feedwater from the condensers 130 and 151 flows through a line 152 to a series of pumps and heaters (not shown). Heated and pressurized feedwater is supplied to the steam generators through the line 103.

A condenser bypass line 153 is connected between the hot reheat header 125 and the condenser 151, and a condenser bypass valve 154 is connected to govern the steam flow through the line 153. An alternate bypass line 155 is connected between the hot reheat header 125 and an alternate steam receiving means, the alternate means being atmosphere in FIG. 1. An alternate bypass valve 156 is connected to govern the steam flow through the line 155. An electrohydraulic valve positioner 157 positions the valve 154 at a position related to a signal on an input line 158. An electrohydraulic valve positioner 159 positions the valve 156 at a position related to a signal on an input line 160.

For the purposes of this discussion, it is assumed that the stop valve 147 and the throttle valve 118 are open, unless otherwise stated. Thus the rate of steam flow through the turbines 122 and 123 is governed by the intercept valve 148, and the rate of steam flow through the turbine 120 is governed by the governor valve 119. A device 180 generates a megawatt demand signal on a line 181 representative of a desired power output of the B turbine-generator. The megawatt demand signal is transmitted to a load control system 182 which generates a signal on a line 183 representative of a desired steam flow through the turbines 122 and 123 (intercept valve flow demand) and a signal on a line 184 representative of a desired position of the governor valve 119. An electrohydraulic valve positioner 185 positions the valve 148 to cause a steam flow through the turbines 122 and 123 that is effectively equal to the desired flow represented by the signal on the line 183. An electrohydraulic valve positioner 186 positions the governor valve 119 at a position represented by the signal on the line 184. As hereinafter described the load control system 182 generates the desired steam flow signal on the line 183 and the desired valve position signal on the line 184 such that the power output of the B turbine-generator conforms to the value represented by the megawatt demand signal on the line 181. The device 180 may be a manually set variable signal generator with an output on the line 181, or the device 180 may be a digital computer programmed to calculate a megawatt demand value that is converted by an associated analog to digital converter and transmitted to the line 181. A device 163, which may be a manually set signal generator or a programmed digital computer with an associated digital to analog converter, generates a signal on a line 164 representative of a desired value of steam pressure in the hot reheat header 125. A bypass valve control system 165 is responsive to the detected pressure signal on the line 145, the desired pressure signal on the line 164, and the desired steam flow signal on the line 183 to generate the valve positioner input signals on the lines 158 and 160, as hereinafter described.

Although the stop valves 126 and 147 and the intercept valves 127 and 148 are illustrated as single valves in FIG. 1, it is recognized that each valve corresponds to plurality of valves in typical practice.

Figure 2:
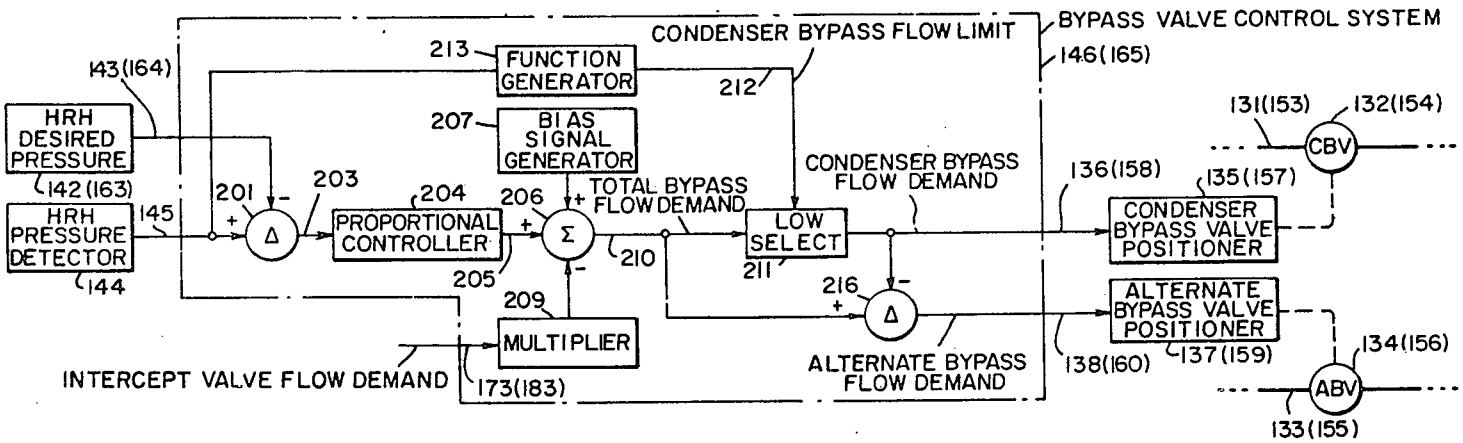
FIG. 2 is a block diagram of a bypass valve control system according to one embodiment of the invention.

Referring to FIG. 2, the bypass valve control system 146 is responsive to the intercept valve flow demand signal on the line 173 to govern the steam flows through the condenser bypass line 131 and the alternate bypass line 133 at such rates that the combined steam flow through the turbines 111 and 112 and the bypass lines 131 and 133 is equal to one-half the desired minimum steam flow through the reheater sections, at times when the steam flow through the turbines 111 and 112 is less than one-half the desired minimum. Because the desired minimum steam flow is sufficient to generate 25% maximum plant power output, it follows that one-half the desired minimum steam flow is sufficient to generate 25% maximum power output of one turbine-generator, as the maximum power capabilities of the A and B turbine-generators are equal. Thus, the steam flow through the turbines 111 and 112 is less than one-half the desired minimum at times when the A turbine-generator is shut down, when the *A* turbine-generator is being accelerated prior to synchronization, after synchronization, when the power output of the A turbine-generator is less than 25% of its maximum power output, the following a trip of the A turbine-generator at a power output in excess of 25% of its maximum power output. The bypass valve control system 146 also responds to a difference between the desired and detected hot reheat header steam pressure signals on the respective lines 143 and 145 to vary the steam flow through one of the bypass lines 131 and 133 to reduce such difference. Usually the bypass valve control system 146 holds the alternate bypass valve 134 closed and varies the steam flow through the condenser bypass line 133 to reduce a difference between the desired and detected pressure signals. However, the bypass valve control system 146 opens the alternate bypass valve 134 to prevent the steam flow through the condenser bypass line 131 from exceeding a corresponding flow limit. When the alternate bypass valve 134 is open, the control system 146 positions the condenser bypass valve 132 to maintain the steam flow through the condenser bypass line 131 at the limit value, and varies the steam flow through the alternate bypass line 133 to reduce a difference between the desired and detected pressure signals.

In more detail with reference to FIG. 2 the intercept valve steam flow demand signal on the line 173 is transmitted through a multiplier 209 to a first input of a summing device 206. A bias signal generator 207 generates a constant bias signal which is connected to a second input of the summing device 206. A comparator 201 generates an output signal on a line 203 which is representative of the difference between the detected pressure signal on the line 145 and the desired pressure signal on the line 143. The signal on the line 203 is transmitted to a proportional controller 204, which generates an output signal connected on a line 205 to a third input of the summing device 206. The summing device 206 subtracts the output signal of the multiplier 209 from the constant bias signal, and adds to the difference of those signals the third input signal on the line 205, to generate an output signal on a line 210. The signal on the line 210 represents total bypass steam flow demand, to be satisfied by steam flow through the condenser bypass line 131 if that flow is less than a corresponding flow limit, or by the combined steam flow through the condenser bypass line 131 and the alternate bypass line 133, otherwise.

The line 210 is connected to a first input of a low select 211. A signal representing a limit value of steam flow through the condenser bypass line 131 is generated by a function generator 213 and is transmitted by a line 212 to a second input of the low select 211. If the total bypass steam flow demand signal is less than the condenser bypass flow limit signal, the low select 211 transmits the total bypass steam flow demand signal to the valve positioner 135, which positions the condenser bypass valve 132 to cause a flow of steam through the condenser bypass line 131 effectively equal to the total bypass steam flow demand, when the steam pressure in the header 125 is at a "low load pressure value." If the total bypass steam flow demand signal exceeds the condenser bypass flow limit signal, the low select 211 transmits the condenser bypass flow limit signal to the valve positioner 135. A comparator 216 generates an output signal representing the excess of the total bypass steam flow demand over the condenser bypass flow limit, and the valve positioner 137 positions the alternate bypass valve 134 to cause a steam flow through the line 133 effectively equal to the flow represented by the output signal of the device 216. The valve positioner 135 positions the condenser bypass valve 132 to cause a flow of steam through the line 131 effectively equal to the condenser bypass flow limit. Then the combined steam flow through the lines 131 and 133 is effectively equal to the total bypass steam flow demand, when the steam pressure in the header 125 is at a "low load pressure value." The output signal of the comparator 216 is zero whenever the total bypass stream flow demand is less than the condenser bypass flow limit, and the alternate bypass valve positioner 137 then holds the alternate bypass valve 134 closed.

Each of the bypass control valves 132 and 134 is characterized by a linear relationship between valve position and steam flow through the valve at constant differential pressure across the valve. The valve positioner associated with each bypass control valve moves the respective valve to a position which is linearly related to the input signal to which the positioner responds. Bypass control valves having non-linear characteristics may be used; when such valves are used each valve positioner is modified to move the associated bypass control valve to a position which is non-linearly related to the respective valve positioner input signal, to compensate the non-linearity of the bypass control valve. A plurality of valves may be utilized to perform the function of the condenser bypass valve 132 or of the alternate bypass valve 134. In that instance a valve positioner is provided for each such valve, and the positioners operate in concert to cause a steam flow through the respective bypass line which is effectively equal to that when a single valve and associated valve positioner are used.

Provided that the detected pressure of steam in the hot reheat header 125 does not deviate from the desired value, the input and output signals of the proportional controller 204 are zero, and the total bypass steam flow demand signal is a function solely of the intercept valve steam flow demand. If the detected pressure of steam in the header 125 differs from the desired pressure, a pressure difference signal is generated by the comparator 201 and is transmitted through the proportional controller 204 to the summing device 206, which modifies the total bypass steam flow demand signal according to the output signal of the controller 204. As the bypass valves 132 and 134 are positioned to satisfy the modified total bypass steam flow demand signal, the pressure difference is reduced.

The following equation relates to the function generator 213:

$$BTU_{max} = K_1 \times F_{max} \times HRHP$$

wherein $BTU_{max}$ = maximum allowable rate of heat delivery to the condenser 130 by the condenser bypass line 131, $K_1$ = proportionality constant, $F_{max}$ = maximum steam flow through the condenser bypass line 131 corresponding to $BTU_{max}$, HRHP = hot reheat header (125) steam pressure. Hence $F_{max} = BTU_{max}/(K_1 \times HRHP)$. In the latter relationship the maximum steam flow in the condenser bypass line 131 varies inversely with the pressure of steam in the header 125. Therefore the function generator 213 is responsive to the output signal of the pressure transducer 144, which represents the detected pressure of steam in the header 125, to generate the signal on the line 212, which represents $F_{max}$, according to the above relationship.

Figure 3A:
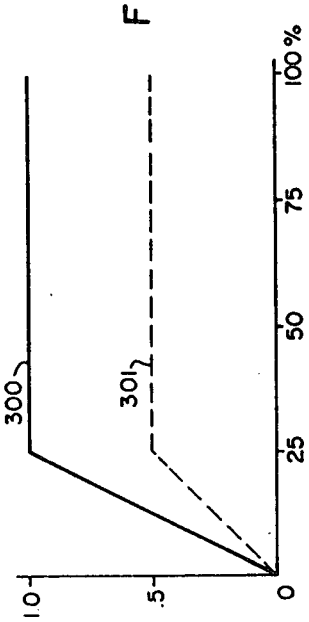
FIGS. 3A and 3B graphically illustrate certain signals generated by the bypass valve control system of FIG. 2.

Referring to FIG. 3A the intercept valve steam flow demand signal on the line 173 is graphically represented (line 300) in relation to the power output of the A turbine-generator. On the vertical axis the intercept valve steam flow demand is shown on a scale normalized between 0 and 1.0. On the horizontal axis the power output of the A turbine-generator is shown in percent of the maximum power output of that turbine-generator. The intercept valve steam flow demand increases from 0 to 1.0 as the power output increases from 0 to 25%. An intercept valve flow demand of O causes the valve positioner 175 (see FIG. 1) to close the intercept valve 127. An intercept valve flow demand of 1.0 causes the valve positioner 175 to to open fully the intercept valve 127. Over the power output range 25% to 100% the intercept valve flow demand is constant at 1.0, and the valve positioner 175 holds the intercept valve 127 fully open over such power output range. Between 0 and 25% power output, the desired steam pressure in the hot reheat header 125 is regulated at a constant value (the "low load pressure value") such that fully opening the intercept valve 127 causes a steam flow through the turbines 111 and 112 effectively equal to one-half the desired minimum steam flow through the reheater sections (see FIG. 1). As the power output of the A turbine-generator increases from O to 25%, the corresponding steam flow through the turbines 111 and 112 increases from zero to one-half the desired minimum steam flow.

Again with reference to FIG. 3A, a dashed line 301 graphically represents the output signal of the multiplier 209 (see FIG. 2) in relation to the power output of the A turbine-generator. The multiplier 209 multiplies the intercept valve steam flow demand signal by a constant factor of .5, therefore the output signal of the multiplier 209 increases in value from 0 to 0.5 as the power output increases from 0 to 25%. Above 25% power output, the output signal of the multiplier 209 is constant at 0.5.

Figure 3B:
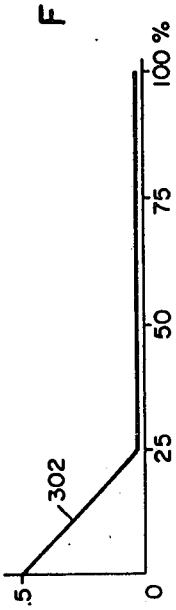

Referring now to FIG. 3B the total bypass steam flow demand signal on the line 210 (see FIG. 2) is graphically represented (line 302) in relation to the power output of the A turbine-generator. On the vertical axis the total bypass steam flow demand signal is shown on a scale between 0 and 0.5. On the horizontal axis the power output of the A turbine-generator is shown in percent. The bias signal generated by the signal generator 207 (see FIG. 2) has a constant value of 0.5 in relation to the output signal of the multiplier 209, which is represented by the dashed line 301 of FIG. 3A. Assuming that the difference between the detected and desired values of hot reheat header steam pressure is zero, the comparator 201 (see FIG. 2) generates a zero output signal on the line 203, and the signal on the line 205 accordingly is zero. Then the total bypass steam flow demand signal is generated by the summing device 206 (see FIG. 2) according to the difference between the constant bias signal of value 0.5 and the output signal of the multiplier 209. As shown in FIG. 3B the total bypass steam flow demand signal decreases from 0.5 to 0 as the power output of the A turbine-generator increases from 0 to 25%. Above 25% power output, the total bypass steam flow demand is constant at O. A total bypass steam flow demand of 0.5 causes the condenser bypass valve positioner 135 to position the condenser bypass valve 132 such that the steam flow through the condenser bypass line 131 is effectively equal to one-half the desired minimum steam flow, when the pressure of steam in the hot reheat header 125 is at the "low load pressure value," and the condenser bypass flow limit is greater than one-half the desired minimum steam flow. Otherwise the valve positioners 135 and 137 position the bypass valves 132 and 134 so that the combined steam flow through the condenser bypass line 131 and the alternate bypass line 133 is effectively equal to one-half the desired minimum, when the hot reheat steam pressure is at the "low load pressure value." A t0tal bypass steam flow demand of O causes the valve positioners 135 and 137 to hold the bypass valves 132 and 134 closed. Thus the combined steam flow through the bypass lines 131 and 133 decreases from one-half the desired minimum steam flow to zero, as the power output of the A turbine-generator increases from 0 to 25%, on the assumption that no pressure difference signal is generated by the comparator 201.

The heavy line 300 of FIG. 3A shows a linear relationship between power output and intercept valve flow demand between 0 and 25% maximum power output for purposes of clarity and simplicity of exposition, and should not be construed as a limitation. The bypass valve control system 146 is equally effective in response to a non-linear relationship between power output and intercept valve flow demand over such a power output range as long as the intercept valve is fully opened at 25% maximum power output.

It is understood that values other than 0.5 may be used for the gain of the multiplier 209 and the value of the bias signal. For example, the bias signal value and the multiplier gain may each be 1.0, in which case the line 173 would be connected directly to the summing device 206 and the valve positioners 135 and 137 would be arranged to position the respective valves 132 and 134 to cause a total steam flow through the lines 131 and 133 which is effectively equal to one-half the desired minimum steam flow when the total bypass flow demand is 1.0 and the hot reheat header steam pressure is at the "low load pressure value." The value 0.5 is suitable when the condenser 135 is capable of condensing the total desired minimum steam flow at the "low load pressure value" of hot reheat steam pressure.

Over the power output range 0 to 25% the output signal of the device 142 represents a constant desired pressure equal to the "low load pressure value." From the above discussion, it is evident that over such power output range the bypass valve control system 146 governs the steam flow through the condenser bypass line 131 and the alternate bypass line 133 so that the combined steam flow through such bypass lines and the turbines 111 and 112 is effectively equal to one-half the desired minimum steam flow, assuming no difference between the detected and desired values of hot reheat header steam pressure. Between power output levels of 0 to 25% an increase of steam flow through the turbines 111 and 112 is accompanied by a corresponding decrease of steam flow through the bypass lines 131 and 133, and in effect the bypass control system 146 "transfers" bypass steam flow to the turbines 111 and 112 as the power output of the A turbine-generator increases, while regulating the steam pressure in the hot reheat header 125.

If a difference between the detected and desired values of hot reheat header steam pressure occurs, the bypass valve control system 146 varies the steam flow through one of the bypass lines 131 and 133 to reduce the difference. In practice such a pressure difference cannot be reduced to zero, as the controller 204 is a proportional controller and permits a residual pressure difference. However, the value of the bias signal generated by the signal generator 207 is such that the magnitude of the residual pressure difference is effectively minimized.

Between 0 and 25% maximum total plant power output the reactor 100 and the helium circulators 102A-102C are operated by controls (not shown) so that the reheater sections of the steam generators are capable of supplying the desired minimum flow of reheated steam when the hot reheat header steam pressure is at the "low load pressure value." Then the bypass valve control system 146 regulates the steam pressure in the header 125 according to the "low load pressure value" and simultaneously governs the steam flow through the bypass lines 131 and 133 so that the combination of steam flows through such lines with the steam flow through the turbines 111 and 112 effectively equals one-half the desired minimum steam flow. If the reactor 100 and the helium circulators 102A–102C are not operated to supply the desired minimum flow of reheated steam at the "low load value," the bypass valve control system 146 varies the steam flow through the bypass lines 131 and 133 to regulate the steam pressure in the hot reheat header 125 according to the desired low load value, but the total steam flow through the bypass lines 131 and 133 and the turbines 111 and 112 differs from one-half the desired minimum steam flow by an amount which depends upon the operation of the reactor and helium circulators.

With reference to FIG. 2 identification numbers in parentheses refer to the bypass valve control system 165 associated with the "B" turbine-generator. The elements and connection of the bypass valve control system 165 are shown within the dashed lines in FIG. 2. The above description of the connection and operation of the bypass valve control system 146 also relates to the control system 165 provided that the numbers in parentheses are substituted for the corresponding numbers in the text, and that the expressions "turbines 122 and 123", "B turbine generator", "intercept valve 148", and "valve positioner 185" are substituted respectively for the expressions "turbines 111 and 112", "A turbine-generator", "intercept valve 127", and "valve positioner 175".

Figure 4:
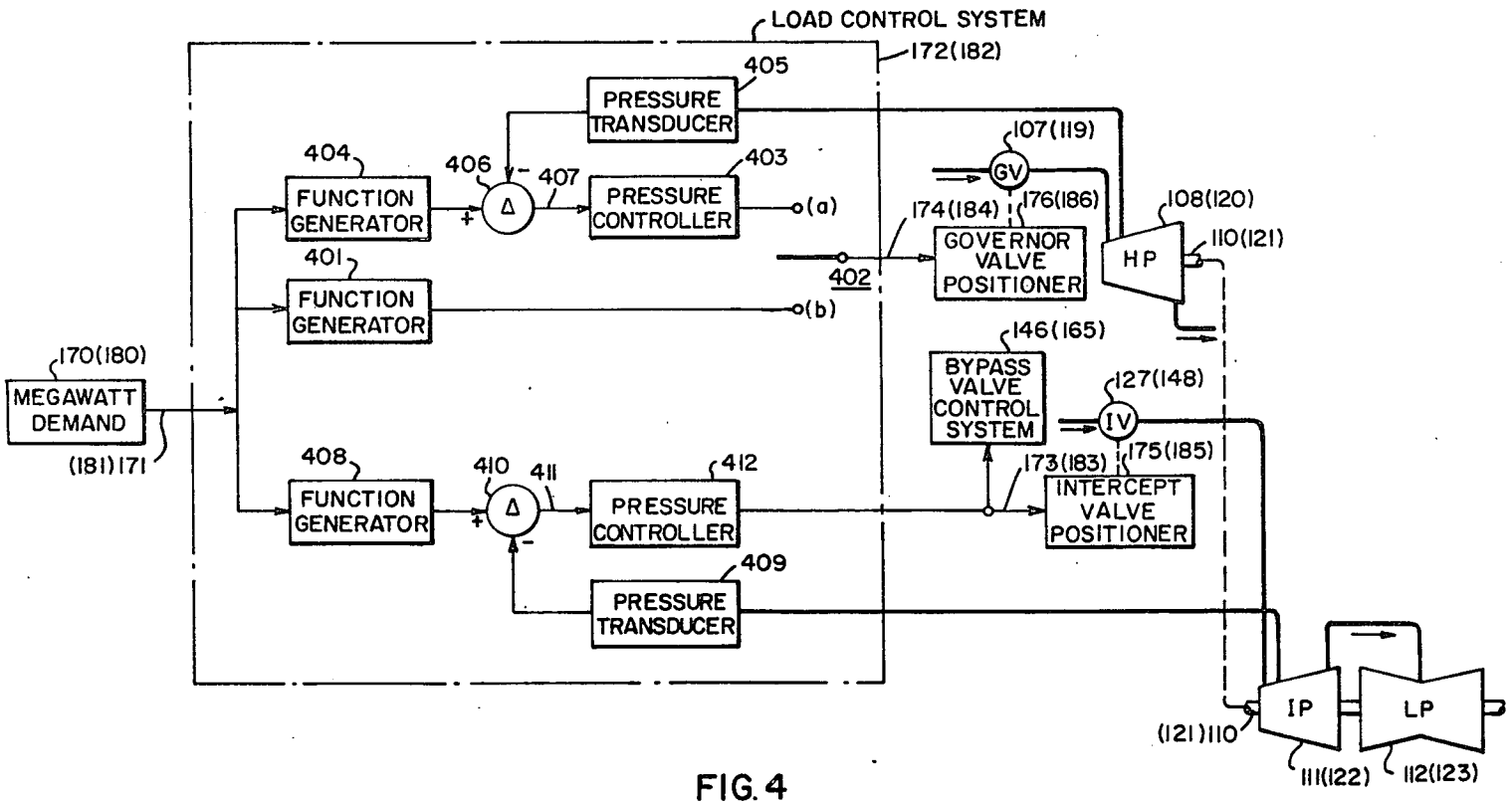
FIG. 4 is a block diagram of a load control system according to one embodiment of the invention.

With reference to FIG. 4 the load control system 172 is responsive to the megawatt demand signal on the line 171 to generate a signal on the line 174 representative of a desired position of the governor valve 107 and a signal on the line 173 representative of a desired steam flow through the turbines 111 and 112. At low loads (loads less than 25% maximum power output of the A turbine-generator requiring turbine steam flows that are less than one-half the desired minimum flow) a function generator 401 generates an output signal representative of a desired position of the governor valve 107 that is in accordance with the megawatt signal on the line 171. A switch 402 is placed in a position "*b*" at such low loads to transmit the desired position signal to the governor valve positioner 176, which positions the governor valve 107 at the position represented by the output signal of the function generator 401. At higher loads (loads greater than 25% maximum power output of the A turbine-generator requiring turbine steam flows that are greater than one-half the desired minimum flow), the switch 402 is placed in the "*a*" position to transmit the output signal at a pressure controller 403 to the governor valve positioner 176. A function generator 404 is responsive to the megawatt demand signal on the line 171 to generate an output signal that represents a desired value of steam pressure in the impulse chamber of the high pressure turbine 108 when the power output of the A turbine-generator is equal to the power output required by the megawatt demand signal. A pressure transducer 405 is connected to detect the pressure of steam in the impulse chamber of the high pressure turbine 108, and generates an output signal representative of the detected pressure. The output signals of the function generator 404 and the pressure transducer 405 are connected to a comparator 406, which generates a signal on an output line 407 that represents the difference between the desired and detected values of steam pressure in the impulse chamber of the high pressure turbine 108. The line 407 is connected to the pressure controller 403, which generates an output signal that is transmitted through the switch 402 to the governor valve positioner 176. At times when there is a difference between the detected and desired values of steam pressure in the impulse chamber of the high pressure turbine 108, the pressure controller 403 varies the position of the governor valve 107 to vary the steam flow through the A turbine to reduce such pressure difference (as hereinafter explained, the intercept valve 127 is fully opened at such times). The pressure controller 403 preferably is a proportional plus integral type of controller wherein the controller output signal comprises the sum of a first signal that is proportional to the signal on the line 407 and a second signal that is proportional to the time integral of the signal on the line 407. When such a controller is utilized the signal on the line 407 is reduced to a steady state value of zero.

A function generator 408 is responsive to the megawatt demand signal on the line 171 to generate an output signal representative of a desired value of steam pressure in the first stage of the intermediate pressure turbine 111. A pressure transducer 409 is connected to detect the pressure of steam in the first stage of the intermediate pressure turbine 111 and generates an output signal representative of the detected pressure value. The output signal of the function generator 408 and the pressure transducer 409 are connected to a comparator 410 which generates an output signal on a line 411 that represents the difference between desired and detected values of steam pressure in the first stage of the intermediate pressure turbine 111. The pressure controller 412 generates an output signal representative of a desired steam flow (intercept valve flow demand) through the turbines 111 and 112. The desired steam flow signal is transmitted to the intercept valve positioner 175, which positions the intercept valve 127 to cause a flow of steam through the turbines 111 and 112 that is effectively equal to the desired value represented by the output signal of the pressure controller 412. The desired steam flow signal generated by the pressure controller 412 also is transmitted to the bypass valve control system 146. At times when there is a difference between the desired and detected values of steam pressure in the first stage of the intermediate pressure turbine 111, the pressure controller 412 varies the position of the intercept valve 127 to vary the flow of steam through the turbines 111 and 112 to reduce such a difference. The pressure controller 412 is of the proportional plus integral type, wherein the output signal of the controller comprises the sum of a first signal that is proportional to the signal on the line 411 and a second signal that is proportional to the time integral of the signal on the line 411. When such a controller is utilized the signal on the line 411 is reduced to a steady state value of zero.

At low loads (as previously defined) the load control system 172 simultaneously governs the steam flows through the high pressure turbine 108 and through the intermediate-low pressure turbines 111 and 112 so that the power output of the A turbine-generator conforms to the desired power output represented by the megawatt demand signal on the line 171. At such low load levels the switch 402 is placed in the "*b*" position, whereby the function generator 401 and the governor valve positioner 176 govern the stem flow through the high pressure turbine 108 in predetermined proportionality with the megawatt demand signal on the line 171. At low load levels the function generator 408 generates a desired value of steam pressure in the first stage of the intermediate pressure turbine 111 that is equal to the value of such pressure when the power output of the A turbine-generator conforms to the value represented by the megawatt demand signal. The pressure controller 412 varies the steam flow through the turbines 111 and 112 to maintain a zero pressure difference signal on the line 411. At low loads the power output of the high pressure turbine 108 is varied in predetermined proportionality with the megawatt demand signal, while the power output of the intermediate-low pressure turbines 111 and 112 is governed in accordance with the desired value of the first stage pressure of the turbine 111, such desired value being generated by the function generator 408 in accordance with the megawatt demand signal.

As the desired power output represented by the megawatt demand signal on the line 171 increases, the load control system 172 operates the valves 107 and 127 to increase the steam flow through the high pressure turbine 108 and the intermediate low pressure turbines 111 and 112. The function generators 401 and 408 are arranged to cause equal variations of the steam flows through the high pressure turbine 108 and the intermediate low pressure turbines 111 and 112. When the megawatt demand signal on the line 171 reaches a value that requires turbine steam flows that are equal to the desired minimum flow, the intercept valve 127 is effectively fully opened, as such valve passes the desired minimum steam flow at the "low load pressure value" to which the steam pressure in the hot reheat header 125 is regulated at low load levels. The bypass valve control system 146 accordingly closes the bypass valves 132 and 134 (see FIG. 2). At megawatt demand levels that exceed the megawatt demand value that corresponds to passage of the desired minimum steam flow through the turbines comprising the A turbine-generator, the load control system 172 holds the intercept valve 127 fully opened, while the bypass valve control system 146 holds the bypass valves 132 and 134 closed. At such megawatt demand levels the switch 402 is placed in the "*a*" position, whereby the pressure controller 403 varies the steam flow through the turbines 108, 111 and 112 to regulate the detected value of steam pressure in the impulse chamber of the high pressure turbine 108 at a desired value of such pressure that is generated by the function generator 404 according to a predetermined relationship between the power output of the A turbine-generator and the steam pressure in the impulse chamber of the high pressure turbine 108. Because the function generator 404 generates the desired impulse chamber pressure in response to the megawatt demand signal on the line 171, the power output of the A turbine-generator is regulated according to the desired power output represented by the megawatt demand signal.

At low load levels the bypass valve 116 is operated (by means not shown) to regulate the pressure of steam in the main steam header 105 at a predetermined pressure value. As the desired power output of the A turbine-generator increases the steam flow through the high pressure turbine 108 increases, and the valve 116 correspondingly is operated to decrease the steam flow through the line 114. At power output levels that require a steam flow through the high pressure turbine 108 that is greater than one-half the desired minimum flow, the valve 116 is held closed.

With reference to FIG. 4 identification numbers in parentheses refer to the load control system 182 associated with the B turbine-generator. The above description of the connection and operation of the load control system 172 also relates to the control system 182 provided that the numbers in parentheses are substituted for the corresponding numbers in the text, and that the expressions "bypass line 155", "bypass valve 117", "bypass valve 154", "bypass valve 156, and 'turbine-generator' are substituted respectively for the expressions "bypass line 114", "bypass valve 116", "bypass valve 132", "bypass valve 134", and 'tubine-benerator.'

In one mode of operation the A and B turbine-generators are loaded simultaneously (after synchronization) between 0 and 25% maximum plant power output. In this mode each of the devices 142 and 163 (see FIG. 2) generates an output signal representative of the "low load pressure value." It is understood that in the mode of operation presently being described a single device may be utilized to generate the desired hot reheat header steam pressure signal on the lines 143 and 164, and that a single comparator 201 and a single proportional controller 204 may be used to generate the signal connected to the summing devices 206 on the lines 205. As hereinafter described, other modes of operation require two of each of the devices 142, 201 and 204. The intercept valve flow demand signals on the lines 173 and 183 are simultaneously increased between 0 and 1 by the load control systems 172 and 182 in response to increasing megawatt demand signals on the lines 171 and 181 (see FIG. 4). In response, the intercept valve positioners 175 and 185 increasingly open the respective intercept valves 127 and 148 to increase the steam flows through the intermediate pressure turbines 111 and 123 in accordance with the intercept valve flow demand signals. At any intercept flow demand value between 0 and 1 the multiplier 209 (see FIG. 2) in each of the bypass valve controllers transmits the respective intercept valve flow demand signal with a gain of one-half to the summing device 206, which subtracts the multiplier output signal from the constant bias signal (assuming that the hot reheat header steam pressure is at the "low load pressure value") to generate the total bypass flow demand value which corresponds to the respective intercept valve flow demand value. The sum of the intercept valve flow demand with the total bypass flow demand is a demand steam flow equal to one-half the desired minimum steam flow through the reheaters. In each bypass valve control system, the low select passes the total bypass flow demand to the condenser bypass valve positioner, which positions the condenser bypass valve to cause a flow of steam through the condenser bypass line equal to the total bypass flow demand when such demand is less than the condenser bypass flow limit and the hot reheat header steam pressure is at the "low load pressure value." If the total bypass flow demand exceeds the condenser bypass flow limit, the low select transmits the condenser bypass flow limit to the condenser bypass valve positioner while the comparator 216 transmits the difference between the total bypass flow demand and the condenser bypass flow limit to the alternate bypass valve positioner. The condenser and alternate bypass valve positioners position the bypass valves to cause steam flows through the bypass lines in accordance with the respective valve positioner input signals, and the combined steam flow through the bypass line is effectively equal to the total bypass flow demand when the hot reheat header steam pressure is at the "low load pressure value." When steam flow through the alternate bypass line is required to satisfy the total bypass flow demand, the condenser bypass steam flow is regulated at the corresponding flow limit, thereby minimizing the flow of steam through the alternate bypass line to atmosphere. At a desired power output between 0 and 25% maximum plant power the bypass valve control systems operate the bypass valves in concert so that the flow of steam through each bypass system (comprising one condenser bypass line and one alternate bypass line) is effectively equal to one-half the difference between desired minimum steam flow and the total steam flow through the turbines 111 and 122. Thus the bypass valve control systems operate the associated bypass valves to maintain the desired minimum steam flow through the reheaters between 0 and 25% maximum plant power, when the hot reheat header pressure is at the "low load pressure value."

If the steam generators cannot supply the desired minimum flow of reheated steam at the "low load pressure value" the comparator 201 in each bypass valve control system generates a pressure difference signal which is transmitted through the proportional controller 204 to the summing device 206, which modifies or "trims" the total bypass flow demand signal according to the controller output signal. When the bypass valves are positioned to cause a total bypass flow in accordance with the modified total bypass flow demand, the pressure difference is reduced.

If the detected pressure exceeds the "low load pressure value" for example, the "trim" signal on the line 205 is positive, thereby increasing the total bypass flow demand to cause a reduction of the pressure difference when the bypass valves are positioned in response to such increased demand. The pressure detector 144, the comparator 201, and the proportional controller 204 thus comprise a pressure feedback path which "trims" the total bypass flow demand (line 302, FIG. 3B) to reduce a difference between the detected and desired values of hot reheat header steam pressure. In event that the "trimmed" total bypass flow demand signal exceeds the corresponding condenser bypass flow limit signal, the low select operates to govern the condenser bypass line flow at its corresponding flow limit, while the "trimmed" total flow demand is satisfied by alternate bypass steam flow, as heretofore described. Thus, the bypass valve control systems operate their associated bypass valves in concert to vary the total bypass flow from the hot reheat header to reduce a difference between detected and desired hot reheat header steam pressure values.

When an integral mode is incorporated in each of the controllers 204, the output signals of the integrators (which ideally are equal) diverge in practice as the integrators individually integrate various disturbances which may affect one but not both of the integrators. Such divergence cause unwanted imbalance between the total bypass flow demand signals, which otherwise would be equal in the above-described simultaneous loading of dual turbine-generators. Although the hot reheat header steam pressure is effectively controlled in the presence of such imbalances, an imbalance may cause one of the total bypass flow demand signals to exceed its corresponding condenser bypass flow limit, resulting in unnecessary and unwanted discharge of steam to atmosphere. Because the controller 204 incorporates a proportional mode rather than a combination of proportional and integral modes, imbalances of the total bypass steam flow demand signals which result from integration of various disturbances are desirably eliminated. While the proportional mode controllers 204 typically permit a residual difference between the detected and desired values of hot reheat header steam pressure, such residual differences are minimized by the bias signals.

As the megawatt demand signals on the lines 171 and 181 are increased in the above examples of simultaneous loading of dual turbine generators, the intercept valves 127 and 148 are increasingly opened by the load control systems 172 and 182 (see FIG. 4) to maintain the detected steam pressures in the first stages of the intermediate pressure turbines 111 and 122 at the desired values of such pressures that are generated by the function generators 408. The desired first stage pressure values increase with increasing megawatt demand signals, and the intercept valves are increasingly opened by the pressure controller 412. Simultaneously the function generators 401 increasingly open the governor valves 176 and 186 in proportion to the increasing megawatt demand signals (the switches 402 are in the *b* position to transmit the output signals of the function generators 401 to the valve positioners 176 and 186). At 25% maximum plant power output the intercept valves 127 and 148 are fully opened. Correspondingly the bypass valves are increasingly closed until they are effectively fully closed at 25% maximum power output. Above 25% maximum plant power output, the pressure of the hot reheat header 125 is permitted to increase with increasing load, and the bypass valve control systems 146 and 165 are operated in the "tracking mode" wherein the devices 142 and 163 generate output signals which are identical to the output signal of the pressure detector 144. Referring to FIG. 2, "tracking mode" operation at power output in excess of 25% maximum plant power assures that the bypass valves 132, 124, 154, and 156 remain closed, because the total bypass steam flow demand (see FIG. 3B) at such power levels, in absence of a pressure difference signal on the line 203 is zero.

In the above example of simultaneous loading of dual turbine-generators, the switches 402 (see FIG. 4) are placed in the "*a*" position when the power output of each turbine-generator exceeds 25% of the maximum power output of that turbine-generator. At such power output levels, the function generators 408 generate desired first stage pressure signals such that the intercept valve 127 and 148 are held open by the pressure controllers 412. Then the pressure controllers 403 position the governor valves 107 and 119 such that the detected steam pressures in the impulse chambers of the high pressure turbines 108 and 120 are maintained equal to the desired values of such pressures that are generated by the corresponding function generators 404. As the desired impulse chamber pressures are generated in accordance with the values of those pressures that prevail when the A and B turbine-generators produce the desired power outputs represented by the respective megawatt demand signals on the lines 171 and 181, the power outputs of the turbine-generators thereby are regulated at the desired values specified by the megawatt demand signals.

Below 25% maximum power output of a turbine-generator, the power output of the intermediate-low pressure turbines is controlled by governing the steam flow through those turbines in accordance with a desired value of steam pressure in the first stage of the intermediate pressure turbine, while the power output of the high pressure turbine is controlled by varying the steam flow through such turbine in proportion to the associated megawatt demand signal, the intercept valve being partially opened at such load levels. Above 25% maximum power output the intercept valve is fully open, and the steam flow through the high and intermediate-low pressure turbines is controlled by positioning the governor valve to reduce a difference between a detected value of steam pressure in the impulse chamber of the high pressure turbine and a desired value of that pressure that is in accordance with the desired power output of the turbine-generator. At load levels that are less than 25% maximum power output it is preferred to control the power output of the high pressure turbine in proportion to the megawatt demand, as the relationship between impulse chamber steam pressure and the power output of the high pressure turbine at such load levels is both non-linear and variable with the hot reheat header steam pressure, thereby precluding accurate control of the power output of the high pressure turbine by varying the steam flow through that turbine to achieve a desired impulse chamber steam pressure value, although the power output of the intermediate-low pressure turbines is accurately controlled at such load levels by varying the steam flow through those turbines in accordance with a desired pressure of steam in the first stage of the intermediate pressure turbine. Above 25% maximum power output of a turbine-generator, the power output is accurately controlled by varying the steam flow through the turbines in accordance with a desired value of steam pressure in the impulse chamber of the high pressure turbine that corresponds to the megawatt demand.

When both turbine-generators operate and one turbine-generator is tripped the stop valve associated with the tripped turbine is closed (by controls not shown). Then only one-half of the steam flow through the reheaters is required by the operating turbine, and the remainder of the reheated steam must be bypassed in order to stabilize the hot reheat header post-trip steam pressure. In the event that each turbine-generator operated at a power output greater than 25% of its maximum output prior to the trip, the bypass valve control system associated with the operating tubine remains in the "tracking mode" in order that none of the excess reheated steam is bypassed to the condenser associated with the operating turbine. After the trip the desired pressure signal associated with the tripped turbine bypass valve control system continues to represent the hot reheat header steam pressure immediately before the trip. The megawatt demand signal associated with the tripped turbine is reduced to zero, causing the load control system associated with the tripped turbine to generate a zero intercept valve steam flow demand. The bypass valve control system associated with the tripped turbine responds to an intercept valve demand of zero (that value corresponding to zero output power as shown in FIG. 3A line 300) and generates a total bypass steam flow demand of value 0.5 (assuming zero pressure difference). The low select transmits flow demand signals to one or both of the condenser and alternate bypass valve positioners as heretofore described, and the valve positioners position the bypass valves according to the valve positioner input signals to cause a flow of bypass steam effectively equal to one-half the desired minimum steam flow were the hot reheat header steam pressure at the "low load pressure value." If the resulting bypass steam flow is not effectively equal to the reheated steam flow which does not pass through the operating turbine, a difference develops between the detected and desired values of hot reheat header steam pressure, and a difference signal is generated by the comparator 201 of the bypass valve control system associated with the tripped turbine. Then the total bypass steam flow demand is "trimmed" by the summing device 206 in accordance with the output signal of the controller 204 to cause a reduction of the pressure difference when the bypass valves are positioned in response to the "trimmed" total bypass steam flow demand. The low select operates to open the alternate bypass valve only when the total bypass flow demand exceeds the condenser bypass flow limit and governs the condenser bypass flow at the flow limit at such times, to minimize the steam which is discharged to atmosphere. The post-trip steam pressure in the hot reheat header thus is stabilized at a value close to the pressure value which prevailed prior to the trip. Posttrip pressure stabilization is advantageous because the operating turbine-generator continues to generate power at its desired power output level without sudden change of the positions of the control valves associated with the operating turbine, and without transient fluctuations of the power generated by the operating turbine-generator which otherwise may result from large post-trip transient excursions of the steam pressure in the hot reheat header. Such pressure stabilization also reduces post-trip transient variation of the shaft speeds of the auxiliary steam turbines (see FIG. 1) and thereby reduces post-trip variation of the reactor coolant gas flow rates.

In event that both turbine-generators are simultaneously tripped at a power output in excess of 25% maximum power output, each of the devices 142 and 163 generates an output signal after the trip which is representative of the hot reheat header steam pressure immediately before the trip. After the trip the megawatt demand signals of the lines 171 and 181 are reset to zero to cause the load control systems 172 and 182 to generate zero intercept valve flow demand signals on the lines 173 and 183. After the trip the detector 144 generates an output signal representative of the post-trip steam pressure in the hot reheat header. The bypass valve control systems 146 and 165 operate the respective bypass valves in concert to bypass the steam flow from the reheaters, and thereby regulate the hot reheat header pressure at the pre-trip pressure value. Single and dual turbine trips may occur at power output levels, below 25% maximum power output. The bypass valve control systems operate the bypass valves as above described to regulate the post-trip hot reheat header steam pressure, the difference being that the pressure is regulated at the "low load pressure value" following a trip at such lower power levels.

In another mode of operation, one turbine-generator, the A turbine-generator for example, may be loaded in the dual turbine power plant shown in FIG. 1. The B turbine-generator is shut down, and the valves 147, 154 and 156 are closed. Therefore the desired minimum steam flow through the reheaters corresponds to generation of 50% of the maximum power output of the A turbine-generator, as the desired minimum flow corresponds to generation of 25% of the maximum power output of each turbine-generator when both the A and B turbine-generators operate. At load levels that are less than 25% maximum power output of the A turbine-generator, the device 142 (see FIG. 2) generates a desired hot reheat header steam pressure signal that represents the "low load pressure value". When the megawatt demand signal on the line 171 (see FIG. 4) is zero, the corresponding intercept valve flow demand signal on the line 173 is 0. In absence of a difference between detected and desired values of hot reheat header steam pressure, the total bypass flow demand signal on the line 210 of the bypass valve control system 146 (see FIG. 2) is of the value 0.5 (see FIG. 3b) corresponding to passage of one-half the desired minimum steam flow through the bypass lines 131 and 133 (see FIG. 2). A difference develops between th detected pressure of steam in the hot reheat header 125 and the "low load pressure value", whereby the controller 204 generates an output signal of value 0.5, and the summing device 206 raises the total bypass flow demand on the line 210 of the bypass valve control system 146 to 1.0 ad the valves 132 and 134 are positioned to permit passage of the desired minimum flow through the bypass lines 131 and 133.

As the megawatt demand signal on the line 171 (see FIG. 4) is increased from 0 to 25% of the maximum power output of the A turbine-generator, the desired hot reheat header pressure signal is constant as the "low load pressure value". As the megawatt demand signal on the line 171 increases between 0 and 25%, the load control system 172 increasingly opens the governor valve 107 and the intercept valve 127 as heretofore discussed, and at 25% maximum power output of the A turbine-generator, the governor valve 107 is partially opened and the intercept valve 127 is fully opened, with one-half the desired minimum flow passing through the high pressure turbine 108 and the intermediate-low pressure turbines 111 and 112. Although the intercept valve 127 is fully opened at such load level, the bypass valves 132 and 134 (see FIG. 2) are positioned by the bypass valve control system 146 to pass one-half the desired minimum steam flow through the bypass lines 131 and 133.

Between megawatt demand values of 25% and 50% of the maximum power output of the A turbine-generator, the desired hot reheat header steam pressure signal on the line 143 is increased from the "load pressure value" to the hot reheat header steam pressure that corresponds to passage of the desired minimum steam flow through the turbines 111 and 112. As the megawatt demand signal increases between 25% and 50% maximum power output of the A turbine generator, the load control system 172 (see FIG. 4) increasingly opens the governor valve 107 until at 50% megawatt demand, the desired maximum steam flow passes through the high pressure turbine 108. As the megawatt demand signal increases between 25% and 50% maximum power output of the A turbine-generator, the desired hot reheat header steam pressure signal on the line 143 (see FIG. 2) correspondingly increases to cause the steam flow through the turbines 111 and 112 to increase at the same rate as the steam flow through the high pressure turbine 108. In response, the bypass valve control system 146 operates the bypass valves 132 and 134 to decrease the steam flow through the bypass lines 131 and 133, until at 50% megawatt demand the valves 132 and 134 are effectively fully closed and the steam flow through the turbines 111 and 112 is equal to the desired minimum flow.

Between megawatt demands of 50% and 100% maximum power output of the A turbine-generator, the load control system 172 (see FIG. 4) operates the governor valve 107 to control the power output of such turbine-generator, as heretofore described. As previously discussed the intercept valve 127 is held fully open by the load control system 172 between megawatt demand values of 25% and 100%. At megawatt demand values that exceed 50% of the power output of the A turbine-generator, the hot reheat header steam pressure is permitted to increase with increasing power output, and by bypass valve control system 146 (see FIG. 2) is operated in the above-described "tracking mode", thereby assuring that the bypass valves 132 and 134 remain closed.

LOADING ONE TURBINE-GENERATOR DURING CONTINUED OPERATION OF THE OTHER

At times during operation of the power plant shown in FIG.. 1, it is desired to load one turbine-generator, for example the B turbine-generator, with the A turbine-generator already generating. For purposes of this discussion the B turbine-generator is assumed to be synchronized, the initial steam flows through the high pressure turbine 120 and the intermediate-low pressure turbines 122 and 123 being just sufficient to maintain the B turbine-generator at its synchronous speed.

The megawatt demand on the A turbine-generator, as represented by the signal on the line 171, first is reduced to a level at which the desired minimum steam flow through the reheater sections passes through the turbines 108, 111 and 112. Because loading of the B turbine-generator has not commenced, the megawatt demand on the A turbine-generator that corresponds to such turbine steam flows is approximately 50 percent of the A turbine-generator's maximum power output. As the megawatt demand signal on the line 171 is reduced to a level which corresponds to fifty percent of the maximum power output of the A turbine-generator, the load control system 172 closes the governor valve 107 until the power output of the A turbine-generator is effectively equal to fifty percent of its maximum.

The megawatt demand on the A turbine-generator then is reduced from fifty percent to twenty-five percent in order to transfer steam flow from the turbine 108 preferably to the bypass line 115 and from the turbines 111 and 112 preferably to the bypass line 153 (and if necessary to the line 155). Between fifty and twenty-five percent megawatt demand on the A turbine-generator, the desired pressure signal on the line 164 is decreased from a level corresponding to 50 percent of maximum power output of the A turbine-generator with the intercept valve 127 fully open, to a level corresponding to 25 percent, with the valve 127 still fully open. At 25 percent megawatt demand on the A turbine-generator, approximately one-half the desired minimum flow through the reheater sections passes through the turbines 108, 111 and 112, while the remainder of the desired minimum flow is conducted by the bypass lines 115, 153, and if necessary 155. Between 50 and 25 percent megawatt demand on the A turbine-generator, the intercept valve 127 remains fully open, the steam flow through the turbines 111 and 112 being reduced by correspondingly reducing the pressure of steam at the outlet of the reheater sections, also referred to as the hot reheat header pressure.

As the load control system 172 closes the governor valve 107 to reduce the steam flow through the turbine 108 between 50 and 25 percent megawatt demand on the A turbine-generator valve 117 is opened (by means not shown) to transfer steam flow from the turbine 108 to the bypass line 115. In response to the above-described decrease of the desired pressure signal on the line 164, the bypass valve control system 165 positions the valve 154 to regulate the detected pressure of steam in the hot reheat header in accordance with the desired value; thereby steam flow is transferred from the turbines 111 and 112 to the line 153 for purposes of reducing the power output of the A turbine-generator while maintaining the desired minimum flow of steam through the reheater sections. The desired pressure signal on the line 164 is decreased at such rate that a decrease of steam flow through the turbine 108 is matched by an equal decrease of the steam flow through the turbines 111 and 112. Thus the steam flow through the turbine 108 is effectively equal to the steam flow through the turbines 111 and 112 at power output levels between fifty and 25 percent of the maximum power output of the A turbine-generator.

When the power output of the A turbine-generator is reduced to twenty-five percent, the steam flow through the bypass lines 115 and 153 is sufficient to generate approximately twenty-five percent of the maximum power output of a turbine-generator, if such bypass steam were transferred to the turbine portions of a turbine-generator.

With steam flowing through the bypass lines 115 and 153 and the A turbine-generator producing 25 percent of its maximum power output, loading of the B turbine-generator commences. The megawatt demand signal on the line 181 is increased until it represents a demand for 25 percent of the maximum power output of the B turbine-generator. During such increase, the desired pressure signal on the line 164 is constant, and it represents the "low load pressure value", that is, the pressure of steam at the outlet of the reheater sections (not reheat header) when the steam flow through the turbines 111 and 112 is effectively equal to one-half the desired minimum flow through the reheater sections with the intercept valve 127 fully open. In response, the intercept valve 148 is opened by the load control system 182 to increase steam flow through the turbines 122 and 123, while the flow through the bypass line 153 (and possibly 155) is correspondingly decreased by the bypass valve control system 165 in order to regulate the pressure of steam in the hot reheat header according to the desired value represented by the signal on the line 164. At 25 percent megawatt demand on the B turbine-generator, the steam flow through the turbines 122 and 123 is essentially equal to one-half the desired minimum flow through the reheater sections, and effectively no steam flows through the bypass lines 153 and 155.

As the B turbine-generator is loaded to 25 percent, the load control system 182 opens the governor valve 119 to increase the steam flow through the turbine 120. An increase of the steam flow through the turbine 120 matches an increase of the flow through the turbines 122 and 123, whereby the flow through the turbine 120 is effectively equal to the flow through the turbines 122 and 123 as the B turbine-generator is loaded to 25 percent. As the flow through the turbine 120 increases, the valve 117 is closed to decrease the flow through the line 115, thereby maintaining a desired minimum flow through the superheater sections. At 25 percent power output of the B turbine-generator, effectively no steam flows through the line 115.

During loading of the B turbine-generator to twenty-five percent of its maximum power output, the A turbine-generator continues to generate twenty-five percent of its maximum power output, and the total steam flow through the turbines 111 and 122 is equal to the desired minimum flow through the reheater sections when each turbine-generator produce 25 percent of its maximum. Thereafter the megawatt demand signals on the lines 171 and 181 are increased preferably in unison, to cause the load control systems 172 and 182 to position the respective governor valves 107 and 119 to raise the power generated by the A and B turbine-generators to a desired level.

During the above-described unloading of the A turbine-generator between 50 and 25 percent of its maximum power output no steam is permitted to flow through the bypass lines 131 and 133; steam flows through such lines are held at zero preferably by generating a desired pressure signal on the line 143 of sufficiently elevated level that the control system 146 holds the valves 132 and 134 closed. Such a desired pressure signal on the line 143 is maintained until each turbine-generator produces 25 percent of its maximum power output. At greater power output levels, the bypass valve control systems 146 and 165 are operated in the previously described "tracking mode".

At times it is desired to load the B turbine-generator after an extended period during which it has not been generating. In such an instance it is advantageous to load the B turbine-generator using reheat steam of lower temperature than in the above-described loading procedure, for the B turbine-generator is partially cooled and a lower steam temperature is required to reduce thermal stress on various turbine portions. In such case the pressure of steam at the outlet of the reheater sections (hot reheat header) at such reduced temperature also is lower than the above-described loading procedure.

A preferred procedure for loading the B turbine-generator at its lower internal temperatures is to reduce the power output of the A turbine-generator to approximately eighteen percent of its maximum power output before commencing to load the B turbine-generator, which initially turns at its synchronous speed.

The A turbine-generator is unloaded to fifty percent of its maximum power output by reducing the megawatt demand signal on the line 171 to cause the load control signal 172 to close the governor valve 107, thereby reducing the steam flows through the turbine 108 and the turbines 111 and 112. Below 50 percent power output of the A turbine-generator, steam flow must be transferred from the turbine portions to the bypass lines 115 and 153, in order to maintain the desired minimum flow through the superheater and the reheater sections.

Between 50 and 25 percent power output of the A turbine-generator, the governor valve 107 is further closed by the load control system 172 to reduce steam flow through the turbine 108, while steam flow through the line 115 is increased by positioning the valve 117 to permit a desired steam flow through the superheater sections. Over such power output range the intercept valve 127 preferably remains fully open, and steam flow through the turbines 111 and 112 is reduced by correspondingly reducing the desired pressure signal on the line 164. In response the bypass valve control system 165 opens the valve 154 to increase the steam flow through the line 153 and thereby to decrease the power output of the turbines 111 and 112 while maintaining the desired minimum flow through the reheater sections. When the power output of the A turbine-generator is reduced to 25 percent of its maximum, the signal on the line 164 represents the pressure of steam in the hot reheat header which has been described previously as the low load pressure value.

As the megawatt demand signal on the line 171 is reduced between levels corresponding to twenty-five and eighteen percent of the maximum power output of the A turbine-generator, the desired pressure signal on the line 164 is decreased from the "low load pressure value" to a "cold standing level" that corresponds to passage of steam through the turbines 111 and 112 at eighteen percent power output of the A turbine-generator with the intercept valve 127 fully open. In response the load control system 172 closes the governor valve 107 to reduce the steam flow through the turbine 108, while the bypass valve 117 is opened additionally to compensate the decreased flow through the turbine 108 and thereby to maintain a desired minimum flow through the superheater sections. The desired pressure signal on the line 164 is reduced to the "cold standby level" at such a rate that the steam flow through the turbine 108 is effectively equal to the flow through the turbines 111 and 112. The control system 165 opens the valve 154 to lower the pressure of steam in the hot reheat header according to the desired pressure signal on the line 164, thereby transferring steam flow from the turbines 111 and 112 to the line 153 while maintaining the desired minimum flow through the reheater sections.

With the power output of the A turbine-generator held at eighteen percent, loading of the B turbine-generator commences. The megawatt demand signal on the line 181 is increased to a level corresponding to 18 percent of the maximum power output of the B turbine-generator; in response, the load control system 182 opens the governor valve 119 and the intercept valve 148 to increase the steam flows through the turbine 120 and the turbines 122 and 123. As the steam flow through the turbine 120 increases, the steam flow through the line 115 correspondingly is decreased by closing the valve 117 while maintaining a desired steam flow through the superheater sections. As the intercept valve 148 opens, the bypass valve control system 165 closes the valve 154 to maintain the detected pressure of steam in the hot reheat header (reheater outlet) at the "cold standby level". Thereby steam flow is transferred from bypass line 153 to the turbines 122 and 123 while the desired minimum steam flow through the reheater sections is maintained. As the power output of the B turbine-generator is increased to eighteen percent, the desired pressure represented by the signal on the line 164 is constant at the "cold standby level". At eighteen percent power output of the B turbine-generator, the intercept valve 148 is effectively fully open. There is, however, a residual steam flow through the line 153 to permit the desired minimum steam flow through the reheater sections.

With each turbine-generator at eighteen percent power output, the megawatt demand signals on the lines 171 and 181 are increased in unison to levels that represent 25 of the maximum power output of each turbine-generator. In response the load control systems 172 and 182 respectively open the governor valves 107 and 119 to increase the steam flows through the turbines 108 and 120. The valve 117 is closed (by means not shown) to correspondingly decrease the steam flow through the bypass line 115, until at 25 percent power output of each turbine-generator effectively no steam flows through the line 115. Between 18 and 25 percent power output of each turbine-generator, steam flow is transferred from the line 153 equally to the turbines 111 and 112 and to the turbines 122 and 123. Because the intercept valves 127 and 148 are fully open, such transfer is accomplished by raising the desired pressure signal on the line 164 from its value during loading of the B turbine-generator to eighteen percent of its maximum power output, to a level corresponding to 25 percent power output of both turbine generators (the "low load pressure value"). In response, the bypass valve control system 165 closes the valve 154 to reduce steam flow through the bypass line 153, thereby transferring steam flow from the line 153 to the turbines 111 and 112 and to the turbines 122 and 123. At 25 percent power output of each turbine-generator, effectively no steam flows through the line 153.

With each turbine-generator at 25 percent power output, the megawatt demand signals on the lines 171 and 181 are increased in unison until each represents a final desired power output of its turbine-generator; in response, the load control systems 172 and 182 open the governor valves 107 and 119 to increase the turbine steam flows in order to achieve actual power outputs that are effectively equal to the final megawatt demands.

As previously described no steam flow is permitted through the lines 131 and 133 during loading of the B turbine-generator. The desired pressure signal on the line 143 is held at a sufficiently elevated level that the control system 146 holds the valves 132 and 134 fully closed. The elevated level is maintained until each turbine-generator produces twenty-five percent power output, whereupon the bypass valve control systems are operated in the "tracking mode".

UNLOADING ONE TURBINE-GENERATOR DURING CONTINUED OPERATION OF THE OTHER

In order to remove from service one turbine-generator, the B turbine-generator for example, while the A turbine-generator continues operaton, the megawatt demand signals on the lines 171 and 181 are reduced until each represents a demand for 25 percent of the maximum power output of its associated turbine-generator. In response, the load control systems 172 and 182 close the respective governor valves 107 and 119 to decrease the power output of each turbine-generator to 25 percent.

At twenty-five percent power output, the signal on the line 171 is held constant at the level which represents twenty-five percent of the maximum power output of the A turbine generator. The desired pressure signal on the line 143 is set to represent the pressure of steam at the outlet of the reheater sections (not reheat header) when each turbine-generator generates 25 percent of its maximum power output that is, the "low load pressure value", and continues to represent such pressure as the power output of the B turbine-generator is reduced.

The megawatt demand signal on the line 181 is reduced from its level corresponding to twenty-five percent maximum power output of the B turbine-generator to a level corresponding to a minimum power output of that turbine-generator. In response the load control system 182 reduces the steam flows through the turbine 120 and the turbines 122 and 123 by closing the governor valve 119 and the intercept valve 148 until the power output of the B turbine-generator is effectively equal to the minimum output that is represented by the signal on the line 181. Steam flow is transferred from the turbine 120 to the bypass line 114 by opening the valve 116 as the governor valve 119 closes, to permit a desired steam flow through the superheater sections. As the intercept valve 148 closes, the bypass valve control system 146 opens the valve 132 (and the valve 134 if necessary) to maintain the pressure of steam at the outlet of the reheater sections (hot reheat header) at the value represented by the signal on the line 143, thereby maintaining the desired minimum steam flow through the reheater sections as the steam flow through the turbines 122 and 123 is reduced.

After the power output of the B turbine-generator is reduced to its minimum level, the turbine-generator is tripped by disconnecting the generator 124 from its associated electric power network (not shown) and by closing the throttle valve 118 and the stop valve 147 to terminate steam flow through the turbine 120 and through the turbines 122 and 123.

After the B turbine-generator is tripped the power output of the A turbine-generator is increased from 25 to 50 percent of its maximum output by correspondingly increasing the megawatt demand signal on the line 171 to cause the load control system 172 to open the governor valve 107 to increase steam flow through the turbine 108. As the governor valve 108 is opened the valve 116 is correspondingly closed to transfer steam flow through the line 114 to the turbine 108, while maintaining the desired minimum flow through the superheater sections.

As the power output of the A turbine-generator is increased between twenty-five and fifty percent, the intercept valve 127 remains fully open; as the megawatt demand signal on the line 171 increases, the desired pressure signal on the line 143 correspondingly is increased to cause the bypass valve control system 146 to close the valve 132 (and the valve 134, if it is opened at all) to reduce steam flow in their respective bypass lines, whereby steam flow through the bypass lines is transferred to the turbines 111 and 112 while the desired minimum flow through the reheater sections is maintained. The desired pressure signal on the line 143 is increased at a rate such that an increase of the steam flow through the turbines 111 and 112 matches an increase of the steam flow through the turbine 108. Thus the steam flow through the turbine 108 is effectively equal to that through the turbine 111 and 112 as the power output of the A turbine-generator is increased from 25 to 50 percent.

At fifty percent of maximum power output of the A turbine-generator, effectively no steam flows through the bypass lines 114 and 131. As the megawatt demand signal on the line 171 is raised from fifty percent to a desired level of the power output of the A turbine-generator, the load control system 172 opens the governor valve 107 to increase the power output of such turbine-generator to match the desired level.

At times it may be desirable to unload and trip the B turbine-generator while the A turbine-generator continues to generate at less than 25% of its maximum output, for example, at 18%. For example, operation of a turbine-generator at a relatively low power output may require a lower pressure of steam at the outlets of the reheater sections (hot reheat header) than at greater power output levels; such lowered pressure raises the pressure differential across the auxiliary steam turbines (see FIG. 1) for desirably improved control of the temperature of steam at the reheater outlets.

By proceeding as above described the power outputs of the turbine-generators are reduced simultaneously until each turbine-generator produces 25% of its maximum power output. Thereupon steam is transferred from each turbine-generator to its respective bypass line, in order to further simultaneously reduce the power output of each turbine-generator to 18% of its maximum. Between 25% and 18% of the maximum power output of a turbine-generator its associated intercept valve remains fully open.

Upon reducing the power output of each turbine-generator to 25% of its maximum, the megawatt demand signals on the lines 171 and 181 are further simultaneously reduced to levels corresponding to 18% of maximum power output, in response to which reduction the load control systems 172 and 182 close the governor valves 107 and 119 to reduce the steam flows through the turbines 108 and 120. As the governor valves close, the valves 116 and 117 are correspondingly opened (by means not shown) to permit a desired steam flow through the superheater sections. The valves 116 and 117 preferably are opened simultaneously so that the steam flows through the lines 114 and 115 are effectively equal.

As the steam flow through a high pressure turbine is decreased to a level corresponding to 18% of the associated turbine-generator's maximum power output, the steam flow through the associated intermediate and low pressure turbines is reduced at the same rate so that the steam flows through the turbine portions are effectively equal. Between 25 and 18% power output levels, the intercept valves 127 and 148 remain fully open, while the steam flows through the turbines 111 and 112 and through the turbines 122 and 123 are reduced by simultaneously reducing the desired pressure signals on the lines 143 and 164 from a level corresponding to 25% to a level corresponding 18% of the maximum power output of a turbine-generator. Thus steam flow is transferred from the intermediate and low pressure turbine portions of the A and B turbine-generators equally to the bypass lines 131 and 153, while the desired minimum steam flow through the reheater sections is maintained. The desired pressure signals are reduced at such a rate that the steam flow through a high pressure turbine is equal to the steam flow through the associated intermediate and low pressure turbines between 25 and 18% of the maximum power output of the turbine-generator.

At 18% power output of each turbine-generator, the megawatt demand signal on the line 171 remains at a level corresponding to that power output of the A turbine-generator, and the desired pressure signals on the lines 143 and 164 are held constant at a level corresponding to 18% power output of each turbine-generator with its intercept valve fully open. The power output of the B turbine-generator is reduced to a minimum level prior to tripping by reducing the signal on the line 181 to cause the load control system 182 to close the governor valve 119 and the intercept valve 148 to reduce the power output of the B turbine-generator to such minimum level. As the governor valve 119 closes, the valve 117 is opened correspondingly to transfer steam flow to the bypass line 115 to maintain a desired stem flow through the superheater sections. As the intercept valve 148 closes, the bypass valve control system 165 increases the steam flow through the line 153 to maintain the desired pressure of steam as represented by the signals on the lines 143 and 164, and thereby to maintain the desired minimum flow through the reheater sections. After the power output of the B turbine-generator is reduced to its minimum level, the turbine-generator is tripped as heretofore described.

After the B turbine-generator is tripped, the power output of the A turbine-generator is increased to 50% of its maximum by transferring steam flow to the turbines portions of the A turbine-generator from the bypass lines that are associated with it. The megawatt demand signal on the line 171 is increased to a level corresponding to fifty percent power output of the A turbine-generator; in response, the load control system 172 opens the governor valve 107 to increase the steam flow through the turbine 108, while the valves 116 and 117 are closed (by means not shown) to maintain a desired minimum flow through the superheater sections. At fifty percent megawatt demand, effectively no steam passes through the bypass lines 114 and 115.

As the signal on the line 171 is increased, the desired pressure signals on the lines 143 and 164 are simultaneously increased to cause the steam flow through the turbines 111 and 112 to increase at the same rate as the steam flow through the turbine 108, while the intercept valve 127 remains fully open. Thus steam flow is transferred from the bypass lines 131 and 153 to the turbines 111 and 112, while the desired minimum flow through the reheater sections is maintained. At fifty percent power output of the A turbine-generator, effectively no steam flows through the lines 131 and 153. As the megawatt demand signal on the line 171 is increased above 50 percent, the load control system 172 opens the governor valve 107 to increase the steam flow through the turbines 108, 111 and 112.

In the first-described procedure for unloading the B turbine-generator, a signal on the line 164 is held at a sufficiently elevated level that the control system 165 holds the valves 154 and 156 closed, the elevated level being maintained until the power output of the A turbine-generator is raised to fifty percent following tripping of the B turbine-generator, whereupon both bypass valve control systems are operated in the "tracking mode." In the second-described procedure, steam is permitted to flow through the bypass lines associated with both turbine-generators. However, the bypass valve control systems are operated in the "tracking mode" after the power output of the A turbine-generator is raised to 50 percent.

What is claimed is:

1. A power plant having a high temperature gas-cooled nuclear reactor and a steam source to derive heat from the coolant gas of the reactor for generating superheat and reheat steam in respective superheater and reheater sections, said power plant comprising, first and second turbine-generators, each of said turbine-generators including at least a high pressure turbine portion connected to pass superheat steam from the superheater section to the reheater section and a lower pressure turbine portion connected to receive reheat steam from the reheater section, the high and low pressure portions of each turbine-generator being rotatably connected to drive an associated electric generating means, first and second governor valve means connected to control the flows of superheat steam through the high pressure portions of the respective first and second turbine-generators, first and second intercept valve means connected to control the flows of reheat steam through the lower pressure portions of the respective first and second turbine-generators, main steam bypass means connected to pass superheat steam from the superheater section to the reheater section without passage through the high pressure turbines to permit a desired minimum flow of steam through such section at times when the total steam flow through the high pressure portions of said first and second turbine-generators is less than such minimum, means for collecting steam after its passage through the high pressure portions of said first and second turbine-generators and through said main steam bypass means, and for passing the collected steam through the reheater section, at least a portion of the steam flow through the reheater section being passed from said steam collecting means through an auxiliary steam turbine means before such portion is reheated, which auxiliary steam turbine means is rotatably coupled to drive a means for circulating the coolant gas through the reactor and the steam source, hot reheat bypass means connected to pass reheat steam from said collecting means to the reheater section without passage through the auxiliary turbine means to permit a desired minimum steam flow through such section at times when the total steam flow through the auxiliary turbine means of said first and second turbine-generators is less than such minimum, first means for positioning said first governor valve means to decrease the power output of said first turbine-generator to a reduced level that is suitable for tripping said second turbine-generator, second means for positioning said second governor valve means to decrease the power output of said second turbine-generator to the reduced level of the power output of said first turbine-generator, and thereupon for positioning said second governor valve means and said second intercept valve means to further reduce the power output of said second turbine-generator to a minimum level at which said second turbine-generator may be tripped, and third means for maintaining a desired steam flow through the reheater section at times when the power generated by said first and second turbine-generators is reduced to a level such that the combined steam flow through the lower pressure turbine portions is less than the desired flow, said third means being responsive at least to changes of a predetermined power plant variable that is related to the flow through the reheater section to govern the flow through said hot reheat bypass means, whereby the desired flow is maintained.

2. A power plant according to claim 1 wherein the steam flow through the lower pressure portion of each of said first and second turbine-generators is equal to one-half the desired minimum flow at times when the power output of each turbine-generator is at the reduced level.

3. A power plant according to claim 1 wherein said hot reheat bypass means includes first and second hot reheat bypass means associated with the respective first and second turbine generators, and no steam flows through said second hot reheat bypass means at times when the total steam flow through the lower pressure portions of said first and second turbine generators is less than the desired minimum, the steam flow through the lower pressure portions of said second turbine-generator being transferred to said first hot reheat bypass means as the power output of said second turbine-generator is decreased.

4. A power plant according to claim 1 wherein said first means positions said first governor valve means to increase the power output of said first turbine-generator from its reduced level after the power output of said second turbine-generator is reduced to its minimum level.

5. A power plant according to claim 1 wherein said hot reheat bypass means includes first and second hot reheat bypass means associated with the respective first and second turbine generators, and at least a portion of the steam flow through the lower pressure portion of said second turbine-generator is transferred to said second hot reheat bypass means as the power output level of such turbine-generator is decreased below the reduced level of the power output of said first turbine-generator.

6. A power plant according to claim 1 wherein the predetermined power plant variable is the pressure of steam at the outlet of the reheater section.

7. A power plant according to claim 6 wherein said third means varies the steam flow through said hot reheat bypass means to reduce a difference between the pressure of steam at the outlet of the reheater section and a desired value of such steam pressure.

8. A power plant according to claim 7 wherein the desired value of the pressure of steam at the outlet of the reheater section is constant when the power output of said first turbine-generator is at its reduced level.

9. A power plant according to claim 8 wherein said first intercept valve means is fully open when the power output of said first turbine-generator is at its reduced level.

10. A power plant having a high temperature gas-cooled nuclear reactor and a steam source to derive heat from the coolant gas of the reactor for generating superheat and reheat steam in respective superheater and reheater sections, said power plant comprising, first and second turbine-generators, each of said turbine-generators including at least a high pressure turbine portion connected to pass superheat steam from the superheater section to the reheater section and a lower pressure turbine portion connected to receive reheat steam from the reheater section, the high and lower pressure portions of each turbine-generator being rotatably connected to drive an associated electric generating means, first and second governor valve means connected to control the flows of superheat steam through the high pressure portions of the respective first and second turbine-generators, first and second intercept valve means connected to control the flows of reheat steam through the lower pressure portions of the respective first and second turbine-generators, main steam bypass means connected to pass superheat steam from the superheater section to the reheater section without passage through the high pressure turbines to permit a desired minimum flow of steam through such section at times when the total steam flow through the high pressure portions of said first and second turbine-generators is less than such minimum, means for collecting steam after its passage through the high pressure portions of said first and second turbine generators and through said main steam bypass means, and for passing the collected steam through the reheater section, at least a portion of the steam flow through the reheater section being passed from said steam collecting means through an auxiliary steam turbine means before such portion is reheated, which auxiliary steam turbine means is rotatably coupled to drive a means for circulating the coolant gas through the reactor and the steam source, hot reheat bypass means connected to pass reheat steam from said collecting means to the reheater section without passage through the auxiliary turbine means to permit a desired minimum steam flow through such section at times when the total steam flows through the auxiliary turbine means of said first and second turbine generators is less than such minimum, first means for positioning said first governor valve means and for governing the steam flow through said hot reheat bypass means to decrease the power output of said first turbine-generator to a reduced level and to maintain the steam flow through the reheater section at its desired minimum level at times when the steam flow through the lower pressure portion of such turbine-generator is less than such desired minimum, such reduced level being suitable for increasing the steam flows through said second turbine-generator, and second means for positioning said second governor valve means and said second intercept valve means to increase the steam flows through the high and lower pressure portions of said second turbine generator from their initial values, to raise the power output of said second turbine-generator to the reduced level of the power output of first turbine-generator.

11. A power plant according to claim 10 wherein said first means includes, means for detecting a value of a power plant variable that is related to the steam flow through the reheater section, means for generating a desired value of the power plant variable detected by said detecting means, and means for varying the steam flow through said hot reheat bypass means to reduce a difference between the desired and detected values.

12. A power plant according to claim 11 wherein the power plant variable is the pressure of steam at the outlet of the reheater section.

13. A power plant according to claim 12 wherein the desired pressure of steam is reduced to transfer steam flow from the lower pressure portion of said first turbine-generator to said hot reheat bypass means, as the power output of such turbine-generator is decreased to its reduced level.

14. A power plant according to claim 13 wherein the desired pressure of steam is constant as the power output of said second turbine-generator is raised to the reduced level.

15. A power plant according to claim 10 wherein said first and second intercept valve means are fully open when the power output of each of said first and second turbine-generators is at the reduced level.

16. A method of loading a second turbine-generator while a first turbine-generator is operated in a dual turbine electric power plant wherein each turbine-generator includes at least a high pressure portion to pass superheat steam to a reheater and a lower pressure portion to receive reheat steam, such turbine portions being rotatably coupled to drive an associated electric generating means, and a steam source derives heat from the coolant gas of a high temperature gas-cooled nuclear reactor for generating superheat steam and reheat steam in respective superheater and reheater sections, first and second governor valve means being connected to control the flows of steam from the superheater section through the high pressure portions of the respective first and second turbine-generators to the reheat section, and first and second intercept valve means being connected to control the flows of steam from the reheater section through the lower pressure portions of the respective first and second turbine generators, and wherein main steam bypass means are connected to pass steam from the superheater section to the reheater section without passage through the high pressure turbines to permit a desired minimum flow of steam through such section when the total steam flow through the high pressure turbine portions is less than such minimum, and hot reheat bypass means are connected to pass steam from collecting means for the reheater section to the low pressure turbines without passage through auxiliary turbine means to permit a desired minimum flow of steam through such section when the total flow through the auxiliary turbine means is less than such minimum, a control valve means being connected to govern the flow of steam through the hot reheat bypass means, at least a portion of the combined steam flow through the high pressure turbine portions and the main steam bypass means being passed from the collecting means through the auxiliary steam turbine means connected to drive a means for circulating the coolant gas through the reactor and the steam source before the combined flow is reheated and passed to the low pressure turbines, said method comprising, positioning the first governor valve means to decrease the power output of the first turbine-generator to a first level, positioning the first governor valve means and the control valve means to reduce the power output of the first turbine-generator to a second level that is less than the first level, positioning the second governor valve means and the second intercept valve means to increase the power output of the second turbine-generator from its initial level, and positioning the control valve means to maintain the desired minimum flow through the reheater section at times when the total steam flow through the lower pressure turbine portions is less than such minimum.

17. A method according to claim 16 wherein the steam flow through the high and lower pressure portions of the first turbine-generator is substantially equal to the desired mininum flow when the power output of the first turbine-generator is at the first level.

18. A method according to claim 16 wherein the step of positioning the control valve means includes, detecting the pressure of steam at the outlet of the reheater section and generating a first signal representative of the detected pressure, generating a second signal representative of a desired value of the pressure of steam at the outlet of the reheater section, and varying the position of the control valve means to reduce a difference between the first and second signals.

19. A method according to claim 18 wherein the second signal is constant during an interval of time over which the power output of the second turbine-generator is increased from its initial level to a level that is equal to the second level.

20. A method according to claim 15 wherein the first intercept valve means remains fully open as the power output of the first turbine-generator is decreased from the first level to the second level.

21. A method according to claim 20 wherein the second intercept valve means is fully open when the power output of the second turbine-generator reaches the second level.

22. A method according to claim 21 wherein the steam flow through the lower pressure portion of a turbine-generator is equal to one-half the desired minimum flow when the power output is at the second level, the control valve means being closed at such time.

23. A method according to claim 21 wherein the combined steam flow through the lower pressure portions of the turbine-generators is less than the desired minimum flow when the power output of each turbine-generator is at the second level, the control valve means being partially open at such time.

24. A method according to claim 23 further comprising, opening the first and second governor valve means to increase the steam flows through the high pressure portions of the turbine-generators, and simultaneously closing the control valve means to transfer steam flow from the hot reheat bypass means equally to the lower pressure portions of the turbine-generators, whereby the power outputs of the turbine-generators are increased uniformly above the second level.

25. A method of unloading a second turbine-generator during continued operation of a first turbine-generator in a dual turbine electric power plant wherein each turbine-generator includes at least a high pressure portion to pass superheat steam to a reheater and a lower pressure portion to receive reheat steam, such turbine portions being rotatably coupled to drive an associated electric generating means, and a steam source derives heat from the coolant gas of a high temperature gas-cooled nuclear reactor for generating superheat steam and reheat steam in respective superheater and reheater sections, first and second governor valve means being connected to control the flows of steam from the superheater section through the high pressure portions of the respective first and second turbine-generators to the reheat section, and first and second intercept valve means being connected to control the flows of steam from the reheat section through the lower pressure portions of the respective first and second turbine-generators, and wherein main steam bypass means are connected to pass steam from the superheater section to the reheater section without passage through the high pressure turbines to permit a desired minimum flow of steam through such section when the total steam flow through the high pressure turbine portions is less than such minimum, and hot reheat bypass means are connected to pass steam from collecting means for the reheater section to the low pressure turbines without passage through auxiliary turbine means to permit a desired minimum flow of steam through such section when the total flow through the auxiliary turbine means is less than such minimum, a control valve means being connected to govern the flow of steam through the hot reheat bypas means, at least a portion of the combined steam flow through the high pressure turbine portions and the main steam bypass means being passed from the collecting means through the auxiliary steam turbine means connected to drive a means for circulating the coolant gas through the reactor and the steam source before the combined flow is reheated and passed to the low pressure turbines, said method comprising, positioning the first and second governor valve means to decrease the combined power output of the first and second turbine-generators to a reduced level at which the total steam flow through the lower pressure turbine portions is less than or equal to the desired minimum flow through the reheater section, positioning the second governor valve means and the second intercept valve means for further reduction of the power output of the second turbine-generator to a predetermined minimum level, and varying the control valve means to maintain the desired minimum flow through the reheater section at times when the total steam flow through the lower pressure portions of the turbine-generators is less than such minimum.

26. A method according to claim 25 further comprising, terminating the steam flows through the high and lower pressure portions of the second turbine-generator to trip such turbine-generator after its power output is reduced to the predetermined minimum level.

27. A method according to claim 26 further comprising, opening the first governor valve means after the second turbine-generator is tripped, and simultaneously closing the control valve means, whereby the power output of the first turbine-generator is increased after the second turbine-generator is tripped.

28. A method according to claim 27 wherein an increase of the steam flow through the high pressure portion of the first turbine-generator matches a corresponding increase of the steam flow through the associated lower pressure portion, whereby the steam flows through such high and lower pressure turbine portions are effectively equal.

29. A method according to claim 25 wherein the first intercept valve means remains fully open during the further reduction of the power output of the second turbine-generator to its predetermined minimum level.

30. A method according to claim 25 wherein the steps of varying the control valve means includes, detecting a value of a power plant variable that is related to the steam flow through the reheater section, generating a signal representative of the detected value, generating a signal representative of a desired value of the detected variable, and varying the control valve means to reduce a difference between the detected and desired value signals.

31. A method according to claim 30 wherein the power plant variable is the pressure of steam at the outlet of the reheater section.

32. A control system for a power plant having a high temperature gas cooled nuclear reactor and a steam source to derive heat from the coolant gas of the reactor for generating superheat and reheat steam in respective superheater and reheater sections, comprising, first and second turbine-generators, each of said turbine-generators including at least a high pressure turbine portion connected to pass superheat steam from the superheater section to the reheater section and a lower pressure turbine portion connected to receive reheat steam from the reheater section, the high and low pressure portions of each turbine-generator being rotatably connected to drive an associated electric generating means, first and second governor valve means connected to control the flows of superheat steam through the high pressure portions of the respective first and second turbine-generators, first and second intercept valve means connected to control the flows of reheat steam through the lower pressure portions of the respective first and second turbine-generators, main steam bypass means connected to pass superheat steam from the superheater section to the reheater section without passage through the high pressure turbines to permit a desired minimum flow of steam through such section at times when the total steam flow through the high pressure portions of said first and second turbine-generators is less than such minimum, means for collecting steam after its passage through the high pressure portions of said first and second turbine-generators and through said main steam bypass means, and for passing the collected steam through the reheater section, at least a portion of the steam flow through the reheater section being passed from said steam collecting means through an auxiliary steam turbine means before such portion is reheated, which auxiliary steam turbine means is rotatably coupled to drive a means for circulating the coolant gas through the reactor and the steam source, hot reheat bypass means connected to pass reheat steam from said collecting means to the reheater section without passage through the auxiliary turbine means to permit a desired minimum steam flow through such section at times when the total steam flow through the auxiliary turbine means of said first and second turbine-generators is less than such minimum, said control system comprising, first means for positioning said first governor valve means to decrease the power output of said first turbine-generator to a reduced level that is suitable for tripping said second turbine-generator, second means for positioning said second governor valve means to decrease the power output of said second turbine-generator to the reduced level of the power output of said first turbine-generator, and thereupon for positioning said second governor valve means and said second intercept valve means to further reduce the power output of said second turbine-generator to a minimum level at which said second turbine-generator may be tripped, and third means for maintaining a desired steam flow through the reheater section at times when the power generated by said first and second turbine-generators is reduced to a level such that the combined steam flow through the lower pressure turbine portions is less than the desired flow, said third means being responsive at least to changes of a predetermined power plant variable that is related to the flow through the reheater section to govern the flow through said hot reheat bypass means, whereby the desired flow is maintained.

33. A control system as set forth in claim 32 wherein said first means positions said first governor valve means to increase the power output of said first turbine-generator from its reduced level after the power output of said second turbine-generator is reduced to its minimum level.

* * * * *